US006656067B2

(12) United States Patent
Ou

(10) Patent No.: US 6,656,067 B2
(45) **Date of Patent: *Dec. 2, 2003**

(54) SPORTSBALL

(76) Inventor: Tsung Ming Ou, No. 32, Lane 56, Chung Cheng 2nd Road, Kaohsiung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/093,808

(22) Filed: Mar. 11, 2002

(65) Prior Publication Data

US 2002/0091024 A1 Jul. 11, 2002

Related U.S. Application Data

(62) Division of application No. 09/752,310, filed on Jan. 2, 2001, which is a continuation-in-part of application No. 09/517,669, filed on May 9, 2000, now Pat. No. 6,390,941, which is a division of application No. 09/752,310, filed on Dec. 20, 1996, now Pat. No. 5,772,545.

(51) Int. Cl.[7] ..... A63B 41/10
(52) U.S. Cl. ..... 473/605
(58) Field of Search ..... 473/599, 603, 473/604, 605, 609

(56) References Cited

U.S. PATENT DOCUMENTS 4,660,831 A * 4/1987 Kralik ..... 473/603
5,772,545 A * 6/1998 Ou ..... 473/605
6,039,662 A * 3/2000 Chan ..... 473/604
6,206,795 B1 * 3/2001 Ou ..... 473/599

* cited by examiner

*Primary Examiner*—Steven Wong
(74) *Attorney, Agent, or Firm*—Raymond Y. Chan; David and Raymond Patent Group

(57) ABSTRACT

A sportsball includes a ball cover, a bladder disposed in the ball cover, and a stress absorbing layer provided between the ball cover and the bladder. The ball cover has a valve hole provided thereon and consists of a plurality of panels each having a predetermined shape connected edge to edge to form a roundness shape. The bladder includes a rubber bladder ball, an exterior web layer integrally adhered on an outer surface of the bladder ball, and a valve stem which is mounted on the bladder ball and is outwardly extended through the valve hole of the ball cover for air inflation. The stress absorbing layer consists of a plurality of sheets each has a predetermined shape corresponding to the shape of the panel and each sheet is attached to an inner surface of the panel of the ball cover to provide a uniform thickness of the ball cover. Therefore, the stress absorbing layer is adapted for not only increasing a contact area between the bladder and the ball cover but also evenly distributing and absorbing an impact force and a stress applied on the sportsball.

12 Claims, 3 Drawing Sheets

SPORTSBALL

CROSS REFERENCE OF RELATED APPLICATION

This application is a divisional application of a non-provisional application, application Ser. No. 09/752,310, filed Jan. 2, 2001, which is a Continuation-In-Part application of application Ser. No. 09/517,669, filed May 9, 2000 now U.S. Pat. No. 6,390,941 B1, which is a divisional application of application Ser. No. 09/752,310, filed Dec. 20, 1996, now U.S. Pat. No. 5,772,545.

BACKGROUND OF THE PRESENT INVENTION

1. Field of Invention

The present invention relates to sportsballs, and more particularly to a durable sportsball adapted for mass production, wherein the sportsball can retain its spherical shape and distribute an impacting stress throughout the ball.

2. Description of Related Arts

Sportsball such as soccer ball and volleyball generally comprises a ball cover and a bladder disposed inside the ball cover. The ball cover, which is preferably made of leather or synthetic leather, has a valve hole provided thereon and consists of a plurality of panels connected edge to edge by machine sewing to form a roundness shape wherein the ball cover is composed of an outer coating, an intermediate layer, and an inner lining layer to strengthen and support the intermediate layer.

Accordingly, the sportsball further comprises an exterior web layer integrally adhered on an outer surface of the bladder wherein the web layer has at least an elongating strengthened thread evenly wound around and around the outer surface of the bladder. So, the strengthened thread is overlapped with each other to form the web layer to entirely embrace the bladder for supporting the ball cover and resisting the stress and impact force of the sportsball.

Since the panels are edge to edge connected together, the ball cover cannot be formed as a prefect spherical interior such that when the bladder is received in the ball cover, the inflated bladder will not fit into the ball cover in full contact, especially at the edges of the panels of the ball cover. Thus, the edges of the ball cover will affect the roundness of the sportsball.

Furthermore, the leather or the thickness and hardened synthetic leather ball cover may make the players feels hurt and pain while contacting the sportsball, especially to children and those training players.

SUMMARY OF THE PRESENT INVENTION

A main object of the present invention is to provide a sportsball which comprises a ball cover well supported by a strengthened bladder. Therefore, no additional lining is required to adhere onto the ball cover, so as to lower the material and manufacturing cost of the sportsball.

Another object of the present invention is to provide a sportsball which has a stress absorbing layer to reduce the painful during contact, especially suitable for children and training players.

Another object of the present invention is to provide a sportsball wherein the bladder has a better flexibility and impact resisting ability.

Another object of the present invention is to provide a sportsball wherein the stress absorbing is adapted for fittedly filling a gap between the ball cover and the bladder so as to provide a better roundness of the sportsball.

Another object of the present invention is provide a sportsball wherein since the stress is distributed on the stress absorbing layer and the bladder but not the ball cover, the expensive leather panels of the ball cover can be thinner to lessen the cost.

Another object of the present invention is to provide a manufacturing method of a sportsball which enables the ball cover to be sewn by sewing machine, and thus it is suitable for mass production.

Accordingly, in order to accomplish the above objects, the present invention provides a sportsball, comprising:

a ball cover having a valve hole provided thereon and a plurality of panels connected edge to edge to form a roundness shape, wherein each of the panels having a predetermined shape has an outer coating layer, an inner lining layer, and an intermediate layer which is integrally formed between the outer coating layer and the inner lining layer and is strengthened and supported by the inner lining layer;

a bladder which is disposed inside the ball cover comprising a bladder ball, an exterior web layer integrally attached on a predetermined area of an outer surface of the bladder ball, and a valve stem which is mounted on the bladder ball and is outwardly extended to an exterior of the ball cover through the valve hole for air inflation, wherein the web layer comprises at least an elongated strengthened thread evenly wound around the outer surface of the bladder ball in such a manner that the strengthened thread is overlapped to form the web layer to entirely embrace the bladder ball for supporting the ball and resisting the stress and impact force applied to the sportsball; and a stress absorbing layer comprising a plurality of absorbing pad having a flexibility ability fittedly attached to the panels respectively for filling up a gap between the ball cover and the bladder, so as to increase the contact area therebetween and reinforce the roundness shape of the sportsball.

Thus, the present invention also provides a specific manufacturing method for producing the sportsball, which comprises the steps of:

(1). Inflate a bladder ball which has a valve stem provided thereon.

(2). Coat at least an elongated strengthened thread such as nylon threads with glue.

(3). Wind the strengthened thread evenly around an outer surface of the bladder ball until the bladder ball is embraced by a web layer of the strengthened thread to form a strengthened bladder.

(4). Heat the bladder in a mold until the web layer is permanently and rigidly united with the outer surface of the bladder ball.

(5). Cut a ball cover material, such as leather or synthetic leather made of foaming PU or PVC sponge material, into a predetermined number of panels in predetermined shape. For soccer ball, 12 pieces of pentagonal panels and 20 pieces of hexagonal panels are cut. For volleyball, 18 pieces of panels in two kinds of rectangular shape are cut.

(6). Sew the panels edge to edge together by sewing machine to form a ball cover which has a valve hole provided thereon, wherein a section of panels is remained unsewn to form an inlet opening.

(7). Cut a stress absorbing layer into a predetermined number of absorbing pads and shapes corresponding to the panels of the ball cover.

(8). Attach the absorbing pads of the stress absorbing layer to the panels of the ball cover.

(9). Heat the ball cover and turn the ball cover right side out.

(10). Insert the strengthened bladder into the ball cover through the inlet opening.

(11). Align and glue the valve stem of the bladder with the valve hole of the ball cover.

(12). Semi-inflate the bladder to ensure that the inflated bladder is adapted for propping against the ball cover.

(13). Sew the inlet opening of the ball cover together by hand.

(14). Fully inflate the sportsball to more than a standard pressure within a shaping mold to ensure a permanent structure and shape of the bladder and the ball cover.

DETAILED DESCRIPTION OF THE PREFERRED EMBODIMENT

Figure 1:
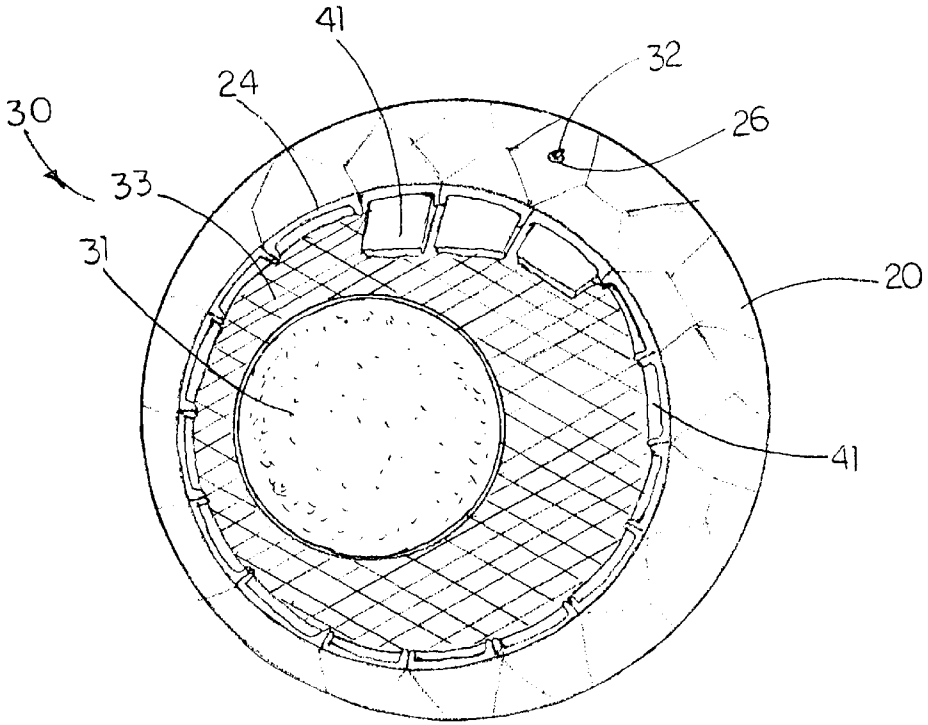
FIG. 1 is a sectional perspective view of a sportsball according to a preferred embodiment of the present invention.
Figure 2:
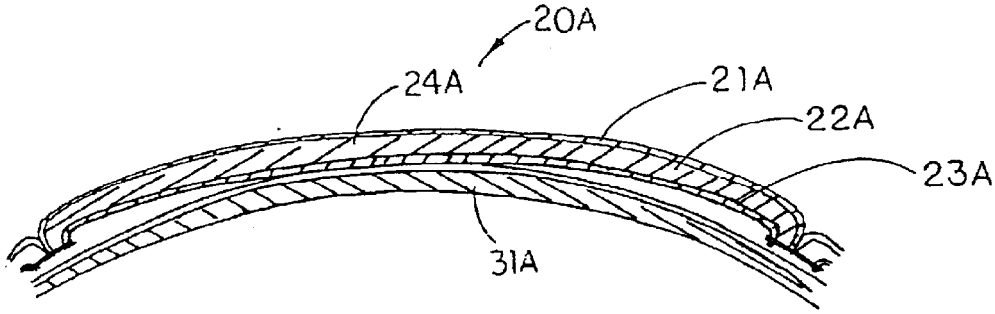
FIG 2 PRIOR ART
FIG. 2 is a partially enlarged sectional view a ball cover of a conventional sportsball.

Referring to FIG. 1 of the drawings, a sportsball according to a preferred embodiment of the present invention is illustrated. The sportsball, such as a soccer ball or a volleyball, comprises a ball cover 20 and a strengthened bladder 30 disposed in the ball cover 20. The ball cover 20 is made of leather or synthetic leather such as polyurethane (PU) or polyvinyl chloride (PVC). The synthetic leather is composed of an outer coating layer 21A, an intermediate layer 22A, and an inner lining layer 23A to strengthen and support the intermediate layer 22A, as shown in FIG. 2.

The leather or synthetic leather is cut into a plurality of panels 24 with predetermined shape. For soccer ball, the most common shape of the panel 24 is pentagon and hexagon. In other words, the ball cover 20 of a soccer ball is made of 12 pieces of pentagonal panel and 20 pieces of hexagonal panel sewn edge to edge by sewing threads 25. The spherical ball cover 20 of a volleyball consists of 18 pieces of rectangular panel sewn edge to edge with sewing threads 25. The ball cover has a valve hole 26 provided thereon.

The inflatable bladder 30, which is disposed inside the ball cover 20, comprises a rubber made bladder 31 and a valve stem 32 mounted thereon and outwardly extended through the valve hole 26 of the ball cover 20 to connect thereto for air inflation. In accordance with the present invention, bladder 30 further comprises an exterior web layer 33 integrally attached on an outer surface of the bladder ball 31. As shown in FIG. 1, the bladder ball 31 is entirely embraced by the web layer 33. The web layer 33 comprises at least an elongated strengthened thread 331 (usually a plurality of strengthened thread 331 being applied), such as nylon threads, evenly wound around and around the outer surface of the bladder ball 31. Therefore, the strengthened thread 331 is overlapped with each other to form the web layer 33.

In order to enable the strengthened thread 331 being permanently affixed on the outer surface of the bladder ball 31, before winding onto the bladder ball 31, the strengthened thread 331 are coated with glue for adhering to the outer surface of the bladder ball 31 and each other. Moreover, the bladder ball 31 with the adhering strengthened thread 331 thereon are together cured by heating in a mold so that the adhering strengthened thread 331 will be hardened to form the web layer 33 which is permanently united with the rubber bladder ball 31 integrally.

Like the fishing net structure or the spider web structure, web structure is one of the most strengthened and rigid construction that can support high stress and resist high impact force. Thus, the web layer 33 highly reinforces the soft and weak rubber bladder ball 31. In other words, the bladder 30 of the present invention is strengthened by the web layer 33 and has a better flexibility and impact resisting ability.

Due to the presence of the valve stem 32 on the bladder 30, the sportsball may lose balance when it is flowing in air, i.e., the sportsball would fall down with the valve stem 32 always directing downwards. In order to ensure a better balance for the sportsball, a rubber pad 34 having the same weight of the valve stem 32 is further integrally adhered to an end, which is opposite to the valve stem 32 of the bladder 30 in order to symmetrically balance the weight of the bladder 30.

The sportsball further comprises a stress absorbing layer 40 provided between the ball cover 20 and the bladder 30 wherein the stress absorbing layer 40 is made of soft, flexible and stress absorbing material such as EVA or foaming PU or PVC. The stress absorbing layer 40 is cut into a plurality of absorbing pads 41 each having a predetermined shape corresponding to the shape of the panel 24 of the ball cover 20. Each absorbing pad 41 of the stress absorbing layer 40 is attached to an inner surface of the respective panel 24 of the ball cover 20 preferably by glue. The stress absorbing layer 40 provides various remarkable features as follows.

When an impact force is applied on the ball cover 20, the major stress is absorbed by the stress absorbing layer 40, which can reduce the stress directly on the ball cover 20 and the bladder 30. Therefore, the sportsball is more durable and has a longer life span. Thus, the stress absorbing layer 40 provides a cushion effect that can reduce the painful while contacting the sportsball, such as heading for soccer players or spiking for volleyball players, especially suitable for the children and training players.

Moreover, each absorbing pad 41 of the stress absorbing layer 40 has a predetermined height in such a manner that the ball cover 20 is adapted for forming a prefect spherical interior to fittedly receive the inflated bladder 30. Since the panels 24 are sewn edge to edge together wherein the edges of the panels 24 are inwardly protruded from the ball cover 20, the interior of the ball cover 20 is not a prefect spherical shape. When air is pumped into the bladder 30 through the valve stem 32 in order to prop up the ball cover 20, the edges of the panels 24 will bias against the outer surface of the bladder ball 31 so as to affect the roundness shape of the sportsball. As shown in FIG. 2, the conventional method of connecting the panels 24A of the ball cover 20A illustrates that the interior of the ball cover 20A is not a prefect spherical shape. A gap is formed between the ball cover 20A and the bladder 31A since the edges of the panels 24A are inwardly extended from the ball cover 20A such that the bladder 31A is not in a round shape when it is inflated.

So, when the absorbing pads 41 of the stress absorbing layer 40 are attached on the ball cover 20, the ball cover 20 has a uniform thickness to provide a prefect spherical interior of the ball cover 20 for fittedly receiving the bladder 30 therein. In other words, when the bladder 30 is inflated, a gap is formed between the bladder ball 31 and the ball cover 20. So, the stress absorbing layer 40 is attached to the ball cover 20 to fittedly fill the gap to increase the contact area between the bladder ball 31 and the ball cover 20, so as to reinforce the roundness shape of the sportsball, as shown in FIG. 3.

Additional supporting linings of the conventional ball cover can be eliminated. The synthetic leather of each panel 24 of the ball cover 20 doest not need to adhere those additional linings to increase its strength. So, the thickness and the hardness of the synthetic leather made ball cover 20 can also be reduced, which enable to utilize thinner sewing threads 25 to sew the panels 24 together. The manufacturing cost and time can be greatly reduced.

Figure 3:
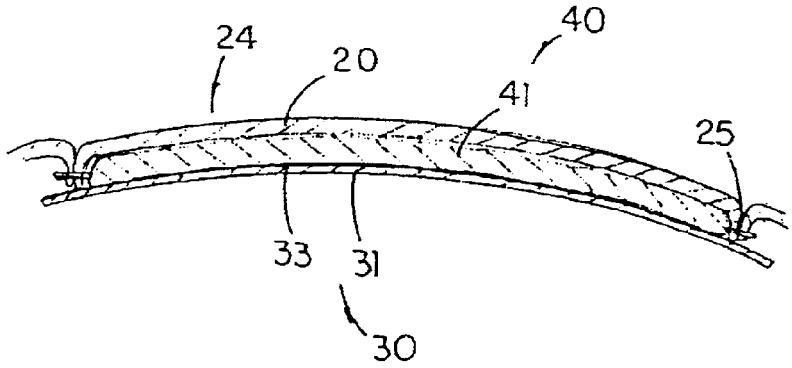
FIG. 3 is a partially enlarged sectional view of the ball cover of the sportsball according to the above preferred embodiment of the present invention.

For leather made ball cover 20, as shown in FIG. 3, since the major stress and impact force is absorbed by the stress absorbing layer 40, the expensive leather panels 24 of the ball cover 20 can be thinner to lessen the cost. Thus, the stress absorbing layer 40 can soften and reinforce the leather ball cover 20.

It is worth to mention that one of the absorbing pads 41 of the stress absorbing layer 40 has a valve through hole 42 provided thereon, which is aligned with the valve hole 26 of the panel 24, such that the stem valve 32 is adapted for extending outwardly through the valve through hole 42.

Figure 4:
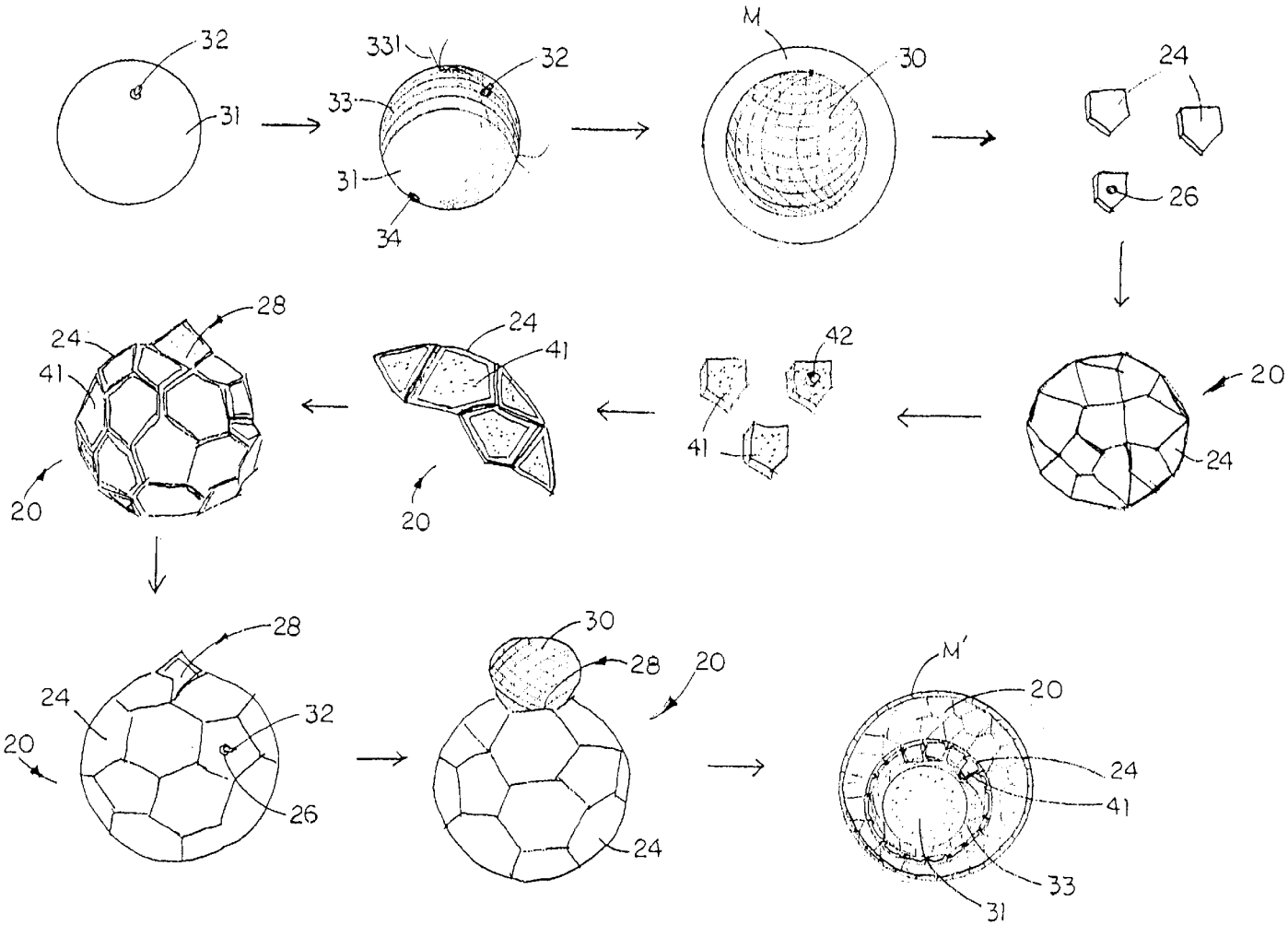
FIG. 4 illustrates a manufacturing method of the sportsball according to the above preferred embodiment of the present invention.

A specific manufacturing method is used to produce the sportsball of the present invention, as illustrated in FIG. 4, which comprises the following steps:

(1). Inflate a bladder ball 31 which has a valve stem 32 provided thereon.

(2). Coat at least an elongated strengthened thread 331 such as nylon threads with glue.

(3). Wind the strengthened thread 331 evenly around an outer surface of the bladder ball 31 until the bladder ball 31 is embraced by a web layer 33 of the strengthened thread 331 to form a strengthened bladder 30.

(4). Heat the bladder 30 in a mold M until the web layer 33 is permanently and rigidly united with the outer surface of the bladder ball 31.

(5). Cut a ball cover material, such as leather or synthetic leather made of foaming PU or PVC sponge material, into a predetermined number of panels 24 in predetermined shape. For soccer ball, 12 pieces of pentagonal panels and 20 pieces of hexagonal panels are cut. For volleyball, 18 pieces of panels in two kinds of rectangular shape are cut.

(6). Sew the panels 24 edge to edge together by sewing machine to form a ball cover 20 which has a valve hole 26 provided thereon, wherein a section of panels is remained unsewn to form an inlet opening 28.

(7). Cut a stress absorbing layer 40 into a predetermined number of absorbing pads 41 and shapes corresponding to the panels 24 of the ball cover 20.

(8). Attach the absorbing pads 41 of the stress absorbing layer 40 to the panels 24 of the ball cover 20.

(9). Heat the ball cover 20 and turn the ball cover 20 right side out.

(10). Insert the strengthened bladder 30 into the ball cover 20 through the inlet opening 28.

(11). Align and glue the valve stem 32 of the bladder 30 with the valve hole 26 of the ball cover 20.

(12). Semi-inflate the bladder 30 to ensure that the inflated bladder 30 is adapted for propping against the ball cover 20.

(13). Sew the inlet opening 28 of the ball cover 20 together by hand.

(14). Fully inflate the sportsball to more than a standard pressure within a shaping mold M' to ensure a permanent structure and shape of the bladder 30 and ball cover 20.

In step (8), when the panels 24 are sewn together, the absorbing pads 41 are fittedly attached to the panels 24 wherein each absorbing pad 41 is encircling with the sewn edges of the panels 24 so as to form a prefect spherical shape of the interior of the ball cover 20. It is worth to mention that the thickness of the absorbing pad 41 is the equal to the sewn edge of the panel 24 and the absorbing pad 41 can be further trimmed in order to form a uniform thickness of the ball cover 20.

As specified above, the valve stem 32 on the bladder 30 may cause the sportsball losing balance when it is flowing in air, i.e. the sportsball fall down with the valve stem 32 always directing downwards. The following step can be applied after the above step (3) in order to ensure a better balance for the sportsball:

(a). Adhere a rubber pad 34 having the same weight of the valve stem 32 integrally to an end, which is opposite to the valve stem 32 of the bladder 30 in order to symmetrically balance the weight of the bladder 30.

According to the improved structure of the sportsball of the present invention, the ball cover 20 can be sewn by the sewing machine and thus it is suitable for mass production. Thus, the strengthened bladder 30 can support and retain the ball cover 20 in the desire roundness even though the bladder 30 is over-inflated up to 15–20% more than the standard pressure of the sportsball. Moreover, the supporting force of the bladder 30 applied to the ball cover 20 through the stress absorbing layer 40 is evenly distributed so that the sportsball can has an even roundness to fulfill most players' desire.

While the foregoing description and diagram describe the preferred embodiment of the present invention, it should be appreciated that certain obvious modifications, variations, and substitutions may be made without departing from the spirit and scope of the present invention. The process steps need not be preformed exactly in the order as outlined above nor are all the process steps delineated above necessary for practicing the present invention.

What is claimed is:

1. A sportsball, comprising:

a ball cover having a valve hole provided thereon and comprises a plurality of panels, each having a predetermined shape, connected edge to edge to form a roundness shape;

a bladder, which is disposed inside said ball cover, comprising a bladder ball, an exterior web layer integrally attached on a predetermined area of an outer surface of the bladder ball, and a valve stem which is mounted on said bladder ball and is outwardly extended to an exterior of said ball cover through said valve hole for air inflation, wherein said web layer comprises at least an elongated strengthened thread evenly wound around said outer surface of said bladder ball in such a manner that said strengthened thread is overlapped to form said web layer to entirely embrace said bladder ball for supporting said bladder ball and resisting a stress and impact force applied to said sportsball, wherein a gap is formed between each of said panels and said bladder after inflation; and a stress absorbing layer comprising a plurality of absorbing pads each having a flexibility ability, wherein said absorbing pads are fittedly attached to said panels respectively, wherein each of said absorbing pads has a thickness to fill up said gap defined between said respective panel and said bladder so as to increase a contact area between said ball cover and said bladder and reinforce said roundness shape of said sportsball.

2. A sportsball, as recited in claim 1, wherein said absorbing pads, each having a predetermined shape corresponding to said panels of said ball cover, are attached to inner surfaces of said panels respectively to provide a uniform thickness of said ball cover.

3. A sportsball, as recited in claim 1, wherein each of said panels of said ball cover, which is made of synthetic leather, has an outer coating layer, an inner lining layer, and an intermediate layer which is integrally formed between said outer coating layer and said inner lining layer and is strengthened and supported by said inner lining layer.

4. A sportsball, as recited in claim 2, wherein each of said panels of said ball cover, which is made of synthetic leather, has an outer coating layer, an inner lining layer, and an intermediate layer which is integrally formed between said outer coating layer and said inner lining layer and is strengthened and supported by said inner lining layer.

5. A sportsball, as recited in claim 1, wherein each of said panels of said ball cover is made of thin leather.

6. A sportsball, as recited in claim 2, wherein each of said panels of said ball cover is made of thin leather.

7. A sportsball, as recited in claim 2, wherein said bladder ball and said strengthened thread thereon is cured together by heating in a mold until said adhering strengthened thread is hardened to form said web layer which is permanently united with said outer surface of said bladder ball integrally.

8. A sportsball, as recited in claim 4, wherein said bladder ball and said strengthened thread thereon is cured together by heating in a mold until said adhering strenthened thread is hardened to form said web layer which is permanently united with said outer surface of said bladder ball integrally.

9. A sportsball, as recited in claim 6, wherein said bladder ball and said strengthened thread thereon is cured together by heating in a mold until said adhering strengthened thread is hardened to form said web layer which is permanently united with said outer surface of said bladder ball integrally.

10. A sportsball, as recited in claim 4, wherein said strengthened thread is a nylon thread.

11. A sportsball, as recited in claim 6, wherein said strengthened thread is a nylon thread.

12. A sportsball, as recited in claim 9, wherein said strengthened thread is a nylon thread.

* * * * *